US011852387B2

(12) United States Patent
Lim et al.

(10) Patent No.: US 11,852,387 B2
(45) Date of Patent: Dec. 26, 2023

(54) REFRIGERATOR

(71) Applicant: LG ELECTRONICS INC., Seoul (KR)

(72) Inventors: Hyoungkeun Lim, Seoul (KR); Seokjun Yun, Seoul (KR); Junghun Lee, Seoul (KR); Hoyoun Lee, Seoul (KR)

(73) Assignee: LG ELECTRONICS, INC., Seoul (KR)

( * ) Notice: Subject to any disclaimer, the term of this patent is extended or adjusted under 35 U.S.C. 154(b) by 93 days.

(21) Appl. No.: 17/433,567

(22) PCT Filed: Feb. 13, 2020

(86) PCT No.: PCT/KR2020/002068

§ 371 (c)(1),
(2) Date: Aug. 24, 2021

(87) PCT Pub. No.: WO2020/175822

PCT Pub. Date: Sep. 3, 2020

(65) Prior Publication Data

US 2022/0146156 A1 May 12, 2022

(30) Foreign Application Priority Data

Feb. 28, 2019 (KR) ..... 10-2019-0023914

(51) Int. Cl.

| | |
|---|---|
| ***F25B 21/04*** | (2006.01) |
| ***F25D 13/04*** | (2006.01) |
| ***F25D 23/06*** | (2006.01) |

(52) U.S. Cl.
CPC ..... *F25B 21/04* (2013.01); *F25D 13/04* (2013.01); *F25D 23/069* (2013.01)

(58) Field of Classification Search
CPC ..... F25D 13/04; F25D 23/069; F25B 21/04; F25B 2321/0252; F25B 41/42; F28F 3/12; F28F 9/0282; F28D 15/00
See application file for complete search history.

(56) References Cited

U.S. PATENT DOCUMENTS

| | | | | |
|---|---|---|---|---|
| 5,871,042 | A * | 2/1999 | Gutfeldt | H01L 23/473 257/E23.098 |
| 6,729,389 | B2 | 5/2004 | Ohashi | |
| 2002/0101718 | A1* | 8/2002 | Negishi | F28F 3/12 257/E23.098 |
| 2005/0257917 | A1* | 11/2005 | East | F28F 3/12 257/E23.098 |

(Continued)

FOREIGN PATENT DOCUMENTS

| | | | |
|---|---|---|---|
| JP | 2001-237357 | A | 8/2001 |
| JP | 2001524202 | A | 11/2001 |

(Continued)

*Primary Examiner* — David J Teitelbaum
(74) *Attorney, Agent, or Firm* — Bryan Cave Leighton Paisner LLP

(57) ABSTRACT

A refrigerator according to an embodiment of the present invention comprises an inlet port and an outlet port which are formed in a sink body forming a heat sink, so as to guide coolant inflow and coolant outflow respectively, wherein the center line of the inlet port passes through the center of a thermoelectric element attached to the heat sink.

4 Claims, 11 Drawing Sheets

(56) References Cited

U.S. PATENT DOCUMENTS

| | | | | |
|---|---|---|---|---|
| 2012/0073309 | A1* | 3/2012 | Hung | F25B 21/02 62/3.3 |
| 2012/0304667 | A1* | 12/2012 | Shin | F25B 21/02 62/3.6 |
| 2017/0098875 | A1* | 4/2017 | Kim | H01M 10/486 |
| 2018/0292119 | A1 | 10/2018 | Sung | |

FOREIGN PATENT DOCUMENTS

| | | | |
|---|---|---|---|
| JP | 2002-098454 | A | 4/2002 |
| JP | 2005045201 | A | 2/2005 |
| JP | 2015-153799 | A | 8/2015 |
| KR | 20160097648 | A | 8/2016 |
| KR | 101821289 | B1 | 1/2018 |
| KR | 10-2018-0080652 | A | 7/2018 |
| KR | 10-2018-0114591 | A | 10/2018 |

* cited by examiner

REFRIGERATOR

This application is a National Stage Application of International Application No. PCT/KR2020/002068, filed on Feb. 13, 2020, which claims the benefit of and priority to Korean Application No. 10-2019-0023914, filed on Feb. 28, 2019, which are hereby incorporated by reference in their entirety for all purposes as if fully set forth herein.

TECHNICAL FIELD

The present invention relates to a refrigerator.

BACKGROUND ART

In general, a refrigerator is a home appliance for storing food at a low temperature, and includes a refrigerating compartment for storing food in a refrigerated state in a range of 3° C. and a freezing compartment for storing food in a frozen state in a range of −20° C.

However, when food such as meat or seafood is stored in the frozen state in the existing freezing compartment, moisture in cells of the meat or seafood are escaped out of the cells in the process of freezing the food at the temperature of −20° C., and thus, the cells are destroyed, and taste of the food is changed during an unfreezing process.

However, destruction of cells may be minimized by setting a temperature condition of the storage compartment to a cryogenic state that is significantly lower than a temperature of the current freezing compartment so that food quickly passes through a freezing point temperature range when the food is changed to a frozen state. As a result, even after thawing, there is an advantage that meat quality and texture return to a state that is close to a state before freezing. The cryogenic temperature may be understood to mean a temperature in a range of −45° C. to −50° C.

For this reason, in recent years, the demand for a refrigerator equipped with a deep freezing compartment that is maintained at a temperature lower than a temperature of the freezing compartment is increasing.

Also, FIG. 2 is a perspective view of the refrigerator door according to an embodiment. In order to satisfy the demand for the deep freezing compartment, there is a limit to the cooling using an existing refrigerant. Thus, an attempt is made to lower the temperature of the deep freezing compartment to a cryogenic temperature by using a thermoelectric module (TEM).

In Korea Patent Publication No. 2018-0114591 (Oct. 19, 2018), which is a prior art, a content, in which a thermoelectric module is employed to provide a deep freezing compartment in a freezing compartment and maintain a deep freezing compartment temperature at a cryogenic temperature that is significantly lower than a freezing compartment temperature, is disclosed.

Particularly, the contents are disclosed that an evaporator through which a refrigerant flows is employed as a heat dissipation means attached to a heat generation surface of the thermoelectric module.

Referring to FIG. 12 and the prior art, one barrier 311 is built in an accommodation portion 350 inside a sink body 310, and a pair of heat exchange fins 340 are disposed in a first space 351 at a left side of the accommodation portion 350 and a second space 352 at a right side of the accommodation portion 350, respectively.

After a refrigerant is introduced into the first space 351 through the refrigerant inflow hole 312, the refrigerant is switched in flow direction at an upper end of the accommodation portion 350 to pass through the second space 352, and then is discharged through a refrigerant discharge hole 313. That is, the refrigerant forms an n-shaped passage in the accommodation portion 350.

In this case, in regions indicated by A, B, and C of FIG. 12, a flow velocity of the refrigerant is too fast, and the refrigerant is discharged from the heat sink in a state in which the refrigerant is not sufficiently heat-exchanged with a heat generation surface of a thermoelectric element. As a result, an entire surface of the heat sink is not maintained at a uniform temperature, and a temperature non-uniformity phenomenon in which a temperature of a specific area is higher or lower than that of another area may occur.

DISCLOSURE OF THE INVENTION

Technical Problem

The present invention has been proposed to improve the above-described limitations.

Technical Solution

A refrigerator according to an embodiment of the present invention for achieving the above object includes: a freezing compartment; a deep freezing compartment accommodated in the freezing compartment and partitioned from the freezing compartment; and a freezing evaporation compartment provided behind the deep freezing compartment.

In addition, the refrigerator according to an embodiment of the present invention includes: a partition wall configured to partition the freezing evaporation compartment and the freezing compartment from each other; a thermoelectric module provided behind the deep freezing compartment so that a temperature of the deep freezing compartment is cooled to a temperature lower than a temperature of the freezing compartment; and a deep freezing compartment fan configured to allow air within the deep freezing compartment to forcibly flow.

In addition, the thermoelectric module may include: a thermoelectric element comprising a heat absorption surface facing the deep freezing compartment and a heat generation surface defined as an opposite surface of the heat absorption surface; a cold sink that is in contact with the heat absorption surface and disposed behind the deep freezing compartment; and a heat sink that is in contact with the heat generation surface and is connected in series to a freezing compartment evaporator.

In addition, the heat sink includes: a sink frame configured to define a refrigerant flow space therein; a front cover coupled to a front surface of the sink frame to shield a front surface of the refrigerant flow space; a rear cover coupled to a rear surface of the sink frame to shield a rear surface of the refrigerant flow space; a plurality of dividers configured to divide the refrigerant flow space into a plurality of spaces; and a plurality of heat exchange fins disposed in the plurality of spaces divided by the plurality of dividers.

In addition, the sink frame may include: an inflow port through which a two-phase refrigerant at a low-temperature and low-pressure after passing through an expansion valve is introduced into the refrigerant flow space; and a discharge port configured to allow the refrigerant of which a temperature is increased by heat exchanging with the heat generation surface of the thermoelectric element while flowing along the refrigerant flow space to be discharged to an outside of the heat sink.

A line passing through a center of the inflow port may pass through a center of a projected surface of the thermoelectric element.

Advantageous Effects

The refrigerator including the foregoing constitutions according to the embodiment of the present invention has following effects.

First, since the refrigerant passage formed inside the heat sink has the meandering shape that is bent multiple times, the time that the refrigerant stays inside the heat sink may increase, and as a result, the refrigerant passing through the heat sink may absorb the sufficient amount of heat from the heat generation surface of the thermoelectric element.

There may be the advantage in that the heat transferred to the heat generation surface of the thermoelectric element is rapidly absorbed and released by the heat sink to improve the cooling capacity and efficiency of the thermoelectric element.

Second, since the heat is rapidly released from the heat sink, the temperature of the heat generation surface of the thermoelectric element may be lowered, and even if the power supplied to the thermoelectric element is maintained constantly, the temperature of the heat absorption surface of the thermoelectric element may be further lowered.

In detail, when the specification of the thermoelectric element and the voltage applied to the thermoelectric element are determined, the temperature difference $\Delta T$ between the heat absorption surface and the heat generation surface of the thermoelectric element may be determined. In this situation, even if the voltage difference applied to the thermoelectric element does not increase, when the temperature of the heat generation surface is lowered, the temperature of the heat absorption surface is further lowered, and thus, the temperature difference ($\Delta T$) may be maintained constantly.

Therefore, since the temperature of the heat absorption surface of the thermoelectric element may be lowered without increasing in power supplied to the thermoelectric element, the cooling capacity and efficiency of the thermoelectric element may be improved.

MODE FOR CARRYING OUT THE INVENTION

Hereinafter, a refrigerator according to an embodiment of the present invention will be described in detail with reference to the accompanying drawings.

Figure 1:
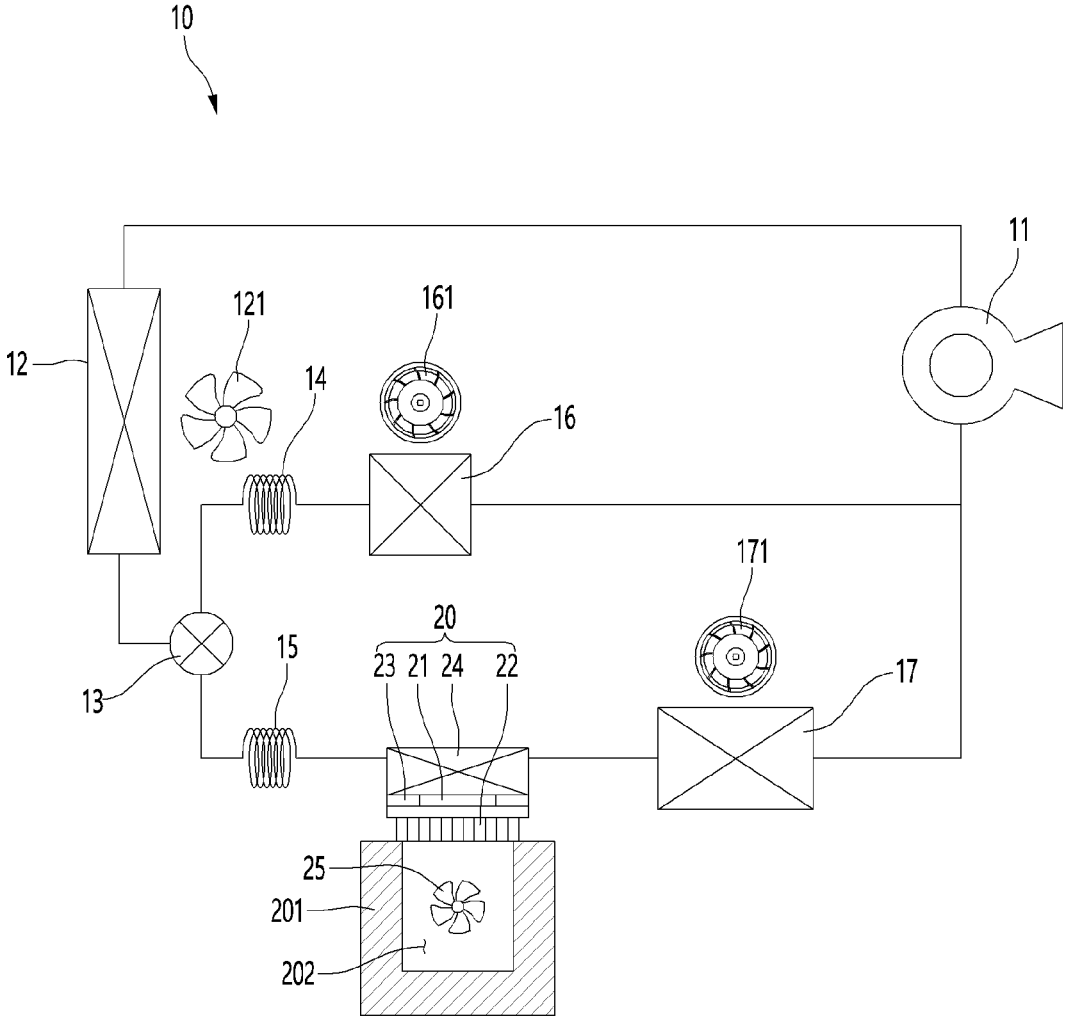
FIG. 1 is a view illustrating a refrigerant circulation system of a refrigerator according to an embodiment of the present invention.

FIG. 1 is a view illustrating a refrigerant circulation system of a refrigerator according to an embodiment of the present invention.

Referring to FIG. 1, a refrigerant circulation system 10 according to an embodiment of the present invention includes a compressor 11 that compresses a refrigerant into a high-temperature and high-pressure gaseous refrigerant, a condenser 12 that condenses the refrigerant discharged from the compressor 11 into a high-temperature and high-pressure liquid refrigerant, an expansion valve that expands the refrigerant discharged from the condenser 12 into a low-temperature and low-pressure two-phase refrigerant, and an evaporator that evaporates the refrigerant passing through the expansion valve into a low-temperature and low-pressure gaseous refrigerant. The refrigerant discharged from the evaporator flows into the compressor 11. Also, the components constituting the refrigerant circulation system are connected to each other by a refrigerant pipe to constitute a closed circuit.

Figure 2:
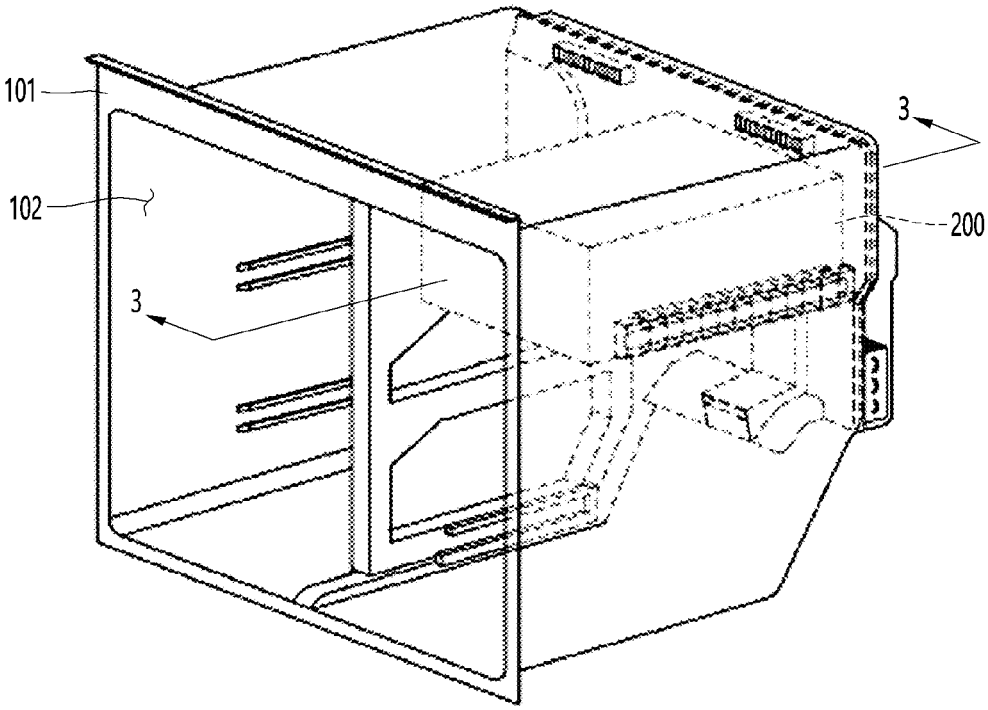
FIG. 2 is a perspective view illustrating structures of a freezing compartment and a deep freezing compartment of the refrigerator according to an embodiment of the present invention.

In detail, the expansion valve may include a refrigerator compartment expansion valve 14 and a freezing compartment expansion valve 15. Also, FIG. 2 is a perspective view of the refrigerator door according to an embodiment. The refrigerant pipe is divided into two branches at an outlet side of the condenser 12, and the refrigerating compartment expansion valve 14 and the freezing compartment expansion valve 15 are respectively connected to the refrigerant pipe that is divided into the two branches. That is, the refrigerating compartment expansion valve 14 and the freezing compartment expansion valve 15 are connected in parallel at the outlet of the condenser 12.

Also, a switching valve 13 is mounted at a point at which the refrigerant pipe is divided into the two branches at the outlet side of the condenser 12. The refrigerant passing through the condenser 12 may flow through only one of the refrigerating compartment expansion valve 14 and the freezing compartment expansion valve 15 by an operation of adjusting an opening degree of the switching valve 13 or may flow to be divided into both sides.

The switching valve 13 may be a three-way valve, and a flow direction of the refrigerant is determined according to an operation mode. Here, one switching valve such as the three-way valve may be mounted at an outlet of the condenser 12 to control the flow direction of the refrigerant, or alternatively, the switching valves are mounted at inlet sides of a refrigerator compartment expansion valve 14 and a freezing compartment expansion valve 15, respectively.

The evaporator may include a refrigerating compartment evaporator 16 connected to an outlet side of the refrigerating compartment expansion valve 14 and a deep freezing compartment evaporator 24 and a freezing compartment evaporator 17, which are connected in series to an outlet side of the freezing compartment expansion valve 15. The deep freezing compartment evaporator 24 and the freezing compartment evaporator 17 are connected in series, and the refrigerant passing through the freezing compartment expansion valve passes through the deep freezing compartment evaporator 24 and then flows into the freezing compartment evaporator 17.

Here, the deep freezing compartment evaporator 24 may be disposed at an outlet side of the freezing compartment evaporator 17 so that the refrigerant passing through the freezing compartment evaporator 17 flows into the deep freezing compartment evaporator 24.

Also, it should be noted that the structure in which the deep freezing compartment evaporator 24 and the freezing compartment evaporator 17 are connected in parallel at an outlet end of the freezing compartment expansion valve 15 is not excluded, and a refrigerant circulation system from which the switching valve 13, the refrigerating compartment expansion valve 14, and the refrigerating compartment evaporator are removed is not also excluded.

Hereinafter, as an example, the description will be limited to the structure in which the heat sink and the freezing compartment evaporator 17 are connected in series.

In addition, it should be noted that a first storage compartment means a storage compartment that is capable of being controlled to a predetermined temperature by a first cooling device, a second storage compartment means a storage compartment that is capable of being controlled to a temperature lower than that of the first storage compartment by the second cooling device, and a third storage compartment is defined as a storage compartment that is capable of being controlled to a temperature lower than that of the storage compartment 2 by a third cooling device.

In addition, the first cooling device may be defined as a unit for cooling the first storage compartment including at least one of a first evaporator and a first thermoelectric element including a thermoelectric element. The first evaporator may include the refrigerating compartment evaporator 16.

In addition, the second cooling device may be defined as a unit for cooling the second storage compartment including at least one of a second evaporator and a second thermoelectric element. The second evaporator may include the freezing compartment evaporator 17.

In addition, the third cooling device may be defined as a unit for cooling the third storage compartment including at least one of a third evaporator and a third thermoelectric element.

In the present invention, as an example, the first storage compartment may be a refrigerating compartment that is controlled to a temperature of above zero by the first cooling device, the second storage compartment is a freezing compartment that is controlled to a temperature below zero by the second cooling device, and the third storage compartment is a deep freezing compartment that is maintained at a temperature of a cryogenic temperature or an ultrafreezing temperature, which will be described later, by the third cooling device.

In the present invention, a case in which all of the third to third storage compartments are controlled to a temperature below zero, a case in which all of the first to third storage compartments are controlled to a above zero temperature, and a case in which the first and second storage compartments are controlled to the above zero temperature, and the third storage compartment is controlled to the temperature below zero are not excluded.

Hereinafter, as an example, the description is limited to the case in which the first storage compartment is the refrigerating compartment, the second storage compartment is the freezing compartment, and the third storage compartment is the deep freezing compartment.

A condensing fan 121 is mounted adjacent to the condenser 12, a refrigerating compartment fan 161 is mounted adjacent to the refrigerating compartment evaporator 16, and a freezing compartment fan 171 is mounted adjacent to the freezing compartment evaporator 17.

A refrigerating compartment maintained at a refrigerating temperature by cold air generated by the refrigerating compartment evaporator 16, a freezing compartment maintained at a freezing temperature by cold air generated by the freezing compartment evaporator 16, and a deep freezing compartment 202 maintained at a cryogenic or ultrafreezing temperature by a thermoelectric module to be described later are formed inside the refrigerator provided with the refrigerant circulation system according to the embodiment of the present invention.

The refrigerating compartment and the freezing compartment may be disposed adjacent to each other in a vertical direction or horizontal direction and are partitioned from each other by a partition wall. In addition, the deep freezing compartment may be provided at one side of the inside of the freezing compartment. In order to block the heat exchange between the cold air of the deep freezing compartment and the cold air of the freezing compartment, the deep freezing compartment 202 may be partitioned from the freezing compartment by a deep freezing case 201 having the high thermal insulation performance.

In addition, the thermoelectric module includes a thermoelectric element 21 having one side through which heat is absorbed and the other side through which heat is released when power is supplied, a cold sink 22 mounted on the heat absorption surface of the thermoelectric element 21, a heat sink mounted on the heat generation surface of the thermoelectric element 21, and an insulator 23 that blocks heat exchange between the cold sink 22 and the heat sink.

Here, the deep freezing compartment evaporator 24 is in contact with the heat generation surface of the thermoelectric element 21 to function as a heat sink. That is, the heat transferred to the heat generation surface of the thermoelectric element 21 is heat-exchanged with the refrigerant flowing inside the deep freezing compartment evaporator 24. FIG. 2 is a perspective view of the refrigerator door according to an embodiment. The refrigerant flowing along the inside of the deep freezing compartment evaporator 24 and absorbing heat from the heat generation surface of the thermoelectric element 21 is introduced into the freezing compartment evaporator 17. Hereinafter, the deep freezing compartment evaporator 24 is defined as a heat sink.

In addition, a cooling fan may be provided in front of the cold sink 22, and the cooling fan may be defined as the deep freezing compartment fan 25 because the fan is disposed behind the inside of the deep freezing compartment.

The deep freezing compartment fan 25 may be a suction type centrifugal fan that suctions air in an axial direction and discharges the suctioned air in a radial direction, and specifically may include a turbo fan.

The cold sink 22 is disposed behind the inside of the deep freezing compartment 202 and configured to be exposed to the cold air of the deep freezing compartment 202. Thus, when the deep freezing compartment fan 25 is driven to forcibly circulate cold air in the deep freezing compartment 202, the cold sink 22 absorbs heat through heat-exchange with the cold air in the deep freezing compartment and then is transferred to the heat absorption surface of the thermoelectric element 21. Also, the heat transferred to the heat absorption surface is transferred to the heat generation surface of the thermoelectric element 21.

Also, FIG. 2 is a perspective view of the refrigerator door according to an embodiment. The heat sink 24 functions to absorb the heat absorbed from the heat absorption surface of the thermoelectric element 21 and transferred to the heat generation surface of the thermoelectric element 21 again to release the heat to the outside of the thermoelectric module 20.

Figure 3:
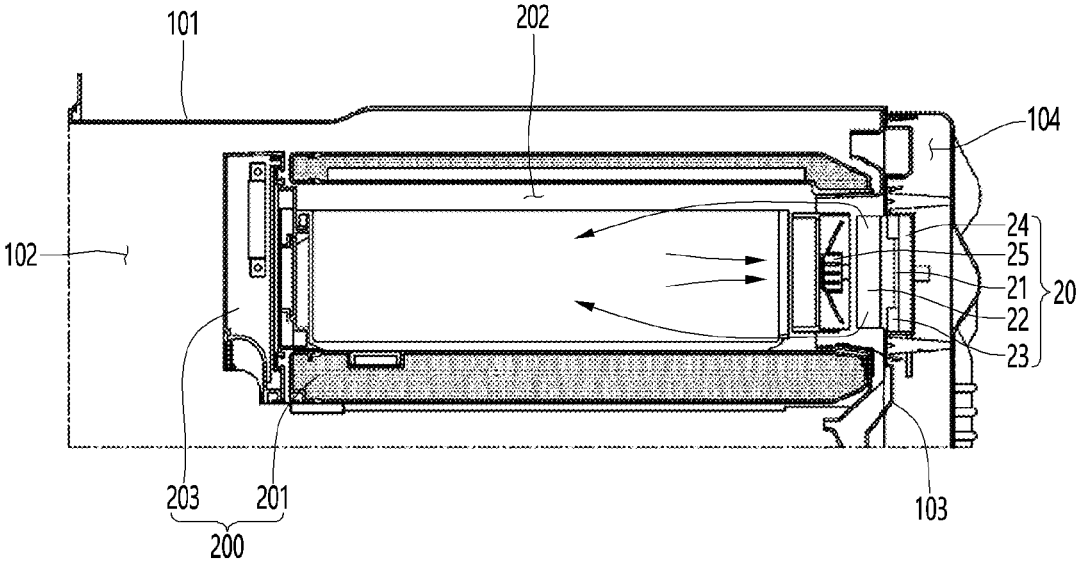
FIG. 3 is a longitudinal cross-sectional view taken along line 3-3 of FIG. 2.

FIG. 2 is a perspective view illustrating structures of the freezing compartment and the deep freezing compartment of the refrigerator according to an embodiment of the present invention, and FIG. 3 is a longitudinal cross-sectional view taken along line 3-3 of FIG. 2.

Referring to FIGS. 2 and 3, the refrigerator according to an embodiment of the present invention includes an inner case 101 defining the freezing compartment 102 and a deep freezing unit 200 mounted at one side of the inside of the freezing compartment 102.

In detail, the inside of the refrigerating compartment is maintained to a temperature of about 3° C., and the inside of the freezing compartment 102 is maintained to a temperature of about −18° C., whereas a temperature inside the deep freezing unit 200, i.e., an internal temperature of the deep freezing compartment 202 has to be maintained to about −50° C. Therefore, in order to maintain the internal temperature of the deep freezing compartment 202 at a cryogenic temperature of −50° C., an additional freezing means such as the thermoelectric module 20 is required in addition to the freezing compartment evaporator.

In more detail, the deep freezing unit 200 includes a deep freezing case 201 that forms a deep freezing compartment 202 therein, a deep freezing compartment drawer 203 slidably inserted into the deep freezing case 201, and a thermoelectric module 20 mounted on a rear surface of the deep freezing case 201.

In addition, the rear surface of the inner case 101 is stepped backward to form a freezing evaporation compartment 104 in which the freezing compartment evaporator 17 is accommodated. Also, an inner space of the inner case 101 is divided into the freezing evaporation compartment 104 and the freezing compartment 102 by the partition wall 103. Also, the thermoelectric module 20 is fixedly mounted on a front surface of the partition wall 103, and a portion of the thermoelectric module 20 passes through the deep freezing case 201 and is accommodated in the deep freezing compartment 202.

In detail, the heat sink 24 constituting the thermoelectric module 20 may be a deep freezing compartment evaporator connected to the freezing compartment expansion valve 15 as described above.

In addition, the thermoelectric module 20 may further include a housing 27 accommodating the heat sink 24. In addition, an insertion hole through which the housing 27 is inserted may be formed in the partition wall 103.

Since the two-phase refrigerant cooled to a temperature of about −18° C. to −30° C. while passing through the freezing compartment expansion valve 15 flows inside the heat sink 24, a surface temperature of the heat sink 24 may be maintained to a temperature of −18° C. to −30° C. Here, it is noted that a temperature and pressure of the refrigerant passing through the freezing compartment expansion valve 15 may vary depending on the freezing compartment temperature condition.

Also, when a rear surface of the thermoelectric element 21 is in contact with a front surface of the heat sink 24, and power is applied to the thermoelectric element 21, the rear surface of the thermoelectric element 21 becomes a heat generation surface.

Also, when the cold sink 22 is in contact with a front surface of the thermoelectric module, and power is applied to the thermoelectric element 21, the front surface of the thermoelectric element 21 becomes a heat absorption surface.

The cold sink 22 may include a heat conduction plate made of an aluminum material and a plurality of heat exchange fins extending from a front surface of the heat conduction plate. Here, the plurality of heat exchange fins extend vertically and are disposed to be spaced apart from each other in a horizontal direction.

Also, the deep freezing compartment fan 25 is disposed in front of the cold sink 22 to forcibly circulate air inside the deep freezing compartment 202.

In addition, the partition wall 103 may include a grille pan 51 exposed to cold air in the freezing compartment, and a shroud 56 attached to a rear surface of the grille pan 51.

In addition, the insertion hole into which the housing 27 is inserted may be formed in the grille pan 51 corresponding to a direct rear side of the thermoelectric module.

Freezing compartment-side discharge grilles 511 and 512 are disposed to protrude from a front surface of the grille pan 51 so as to be vertically spaced apart from each other, and a module sleeve 53 protrudes from the front surface of the grille pan 51 corresponding between the freezing compartment-side discharge grilles 511 and 512. A thermoelectric module accommodation space in which the thermoelectric module 20 is accommodated is formed in the module sleeve 53.

In more detail, a flow guide 532 may be provided in a cylindrical or polygonal cylindrical shape inside the module sleeve 53, and the inside of the flow guide 532 may be divided into a front space and a rear space by a fan grille part 536. A plurality of air through-holes may be formed in the fan grille part 536.

Also, deep freezing compartment-side discharge grilles 533 and 534 may be formed between the module sleeve 53 and the flow guide 532, i.e., an upper side and a lower side of the flow guide 532, respectively.

In addition, the deep freezing compartment fan 25 may be accommodated inside the flow guide 532 corresponding to the rear side of the fan grille part 536. In addition, a portion of the flow guide 532, which corresponds to a front space of the fan grille part 536 serves to guide a flow of cool air so that the cool air in the deep freezing compartment is suctioned into the deep freezing compartment fan 25. That is, the cold air introduced into the inner space of the flow guide 532 to pass through the fan grille part 536 is discharged in a radial direction of the deep freezing compartment fan 25 and is heat-exchanged with the cold sink 22. Then, the cold air that is cooled while being heat-exchanged with the cold sink 22 to flow in a vertical direction is discharged again to the deep freezing compartment through the deep freezing compartment-side discharge grills 533 and 534.

In addition, the thermoelectric module accommodation space may be defined as a space between a rear end of the flow guide 532 (or a rear end of the deep freezing compartment fan 25) and a rear surface of the grille pan 51.

Here, the housing 27 accommodating the heat sink 24 protrudes backward from a rear surface of the partition wall 103 and is placed in the freezing evaporation compartment 104. Thus, a rear surface of the housing 27 is exposed to the cold air of the freezing evaporation compartment 104, and thus, a surface temperature of the housing 27 is substantially maintained at the same or similar level to the temperature of the cold air in the freezing evaporation compartment.

The cold sink 22 may be accommodated in the thermoelectric module accommodation space, and the heat insulator 23, the thermoelectric element 21 and the heat sink 24 are accommodated in the housing 27.

In addition, a drain heater 40 is mounted on a bottom portion of the thermoelectric module accommodation space to melt ice separated from the cold sink 22 during a defrost operation (deep freezing compartment defrost) of the thermoelectric module and then converted into defrost water.

The deep freezing compartment-side discharge grills 533 and 534 may include an upper discharge grille 533 and a lower discharge grille 534.

Then, the cold air inside the deep freezing compartment 202 is suctioned in an axial direction of the deep freezing compartment fan 25, heat-exchanged with the cold sink 22, and then is discharged through the deep freezing compartment-side discharge grills 533 and 534.

Figure 4:
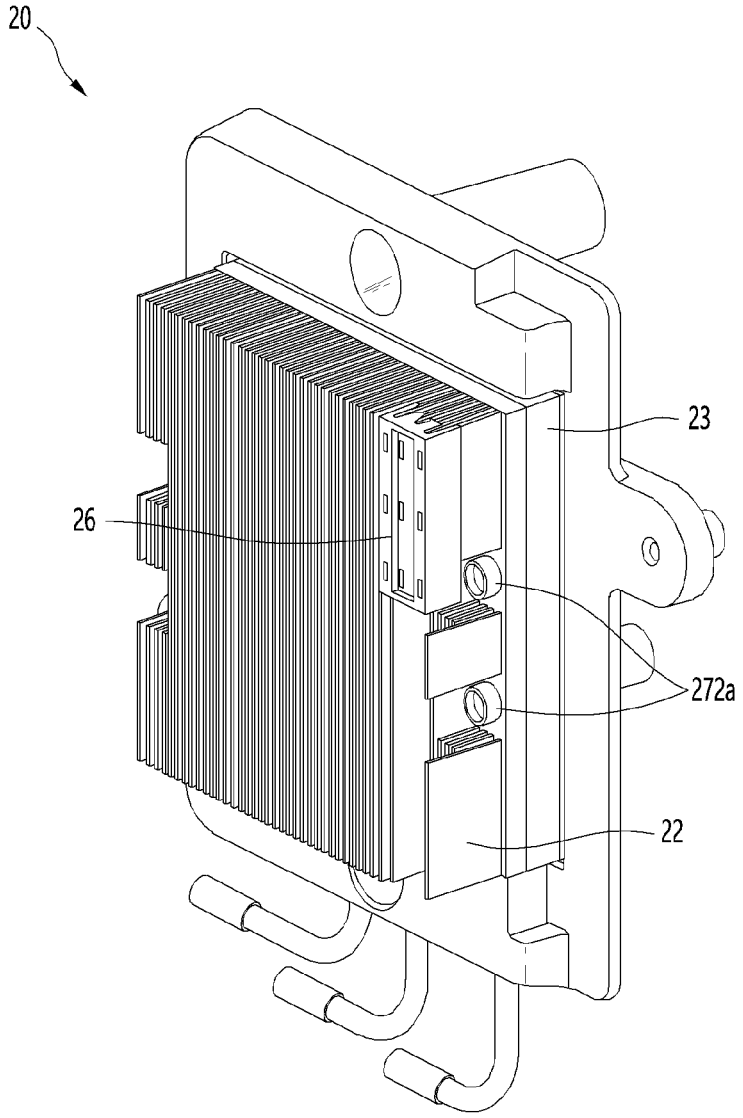
FIG. 4 is a perspective view of a thermoelectric module according to an embodiment of the present invention.
Figure 5:
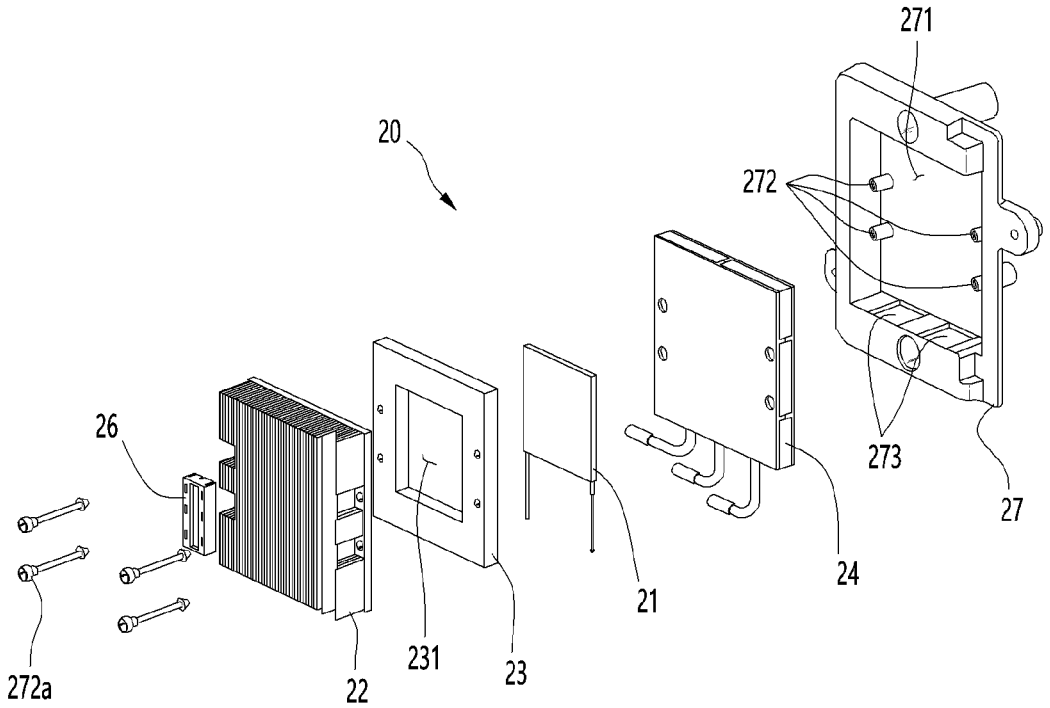
FIG. 5 is an exploded perspective view of the thermoelectric module.

FIG. 4 is a perspective view of the thermoelectric module according to an embodiment of the present invention, and FIG. 5 is an exploded perspective view of the thermoelectric module.

Referring to FIGS. 4 and 5, as described above, the thermoelectric module 20 according to an embodiment of the present invention may include the thermoelectric element 21, the cold sink 22 that is in contact with the heat absorption surface of the thermoelectric element 21, the heat sink 24 that is in contact with the heat generation surface of the thermoelectric element 21, and an insulator 23 for blocking heat transfer between the cold sink 22 and the heat sink 24.

The thermoelectric module 20 may further include a deep freezing compartment fan 25 disposed in front of the cold sink 22.

In addition, the thermoelectric module 20 may further include a defrost sensor 26 mounted on the heat exchange fin of the cold sink 22 to detect a temperature of the cold sink 22. The defrost sensor 26 detects a surface temperature of the cold sink 22 during a defrosting process to transmit the detected temperature information to the controller, thereby determining a defrost completion time point. The controller may also determine whether the defrost is defective based on the temperature value transmitted from the defrost sensor 26.

In addition, the thermoelectric module 20 may further include a housing 27 accommodating the heat sink 24. A heat sink accommodation portion 271 having a size corresponding to a thickness and area of the heat sink 245 may be recessed in the housing 27. A plurality of coupling bosses 272 may protrude from left and right edges of the heat sink accommodation portion 271. Since a coupling member 272*a* passes through both sides of the cold sink 22 and is inserted into the coupling boss 272, the components constituting the thermoelectric module 20 are assembled as a single body.

In addition, since the heat sink 24 connected in series to the freezing compartment evaporator 17 is an evaporator, an inflow pipe 241 through which the refrigerant is introduced and a discharge pipe 242 through which the refrigerant is discharged are provided at an edge of a side surface of the heat sink 24 to extend. A pipe through-hole 273 through which the inflow pipe 241 and the discharge pipe 242 pass may be formed in the housing 27.

In addition, a thermoelectric element accommodation hole 231 corresponding to the size of the thermoelectric element 21 is formed in a center of the heat insulator 23. The insulator 23 may have a thickness greater than that of the thermoelectric element 21, and a rear portion of the cold sink 22 may be inserted into the thermoelectric element accommodation hole 231.

Figure 6:
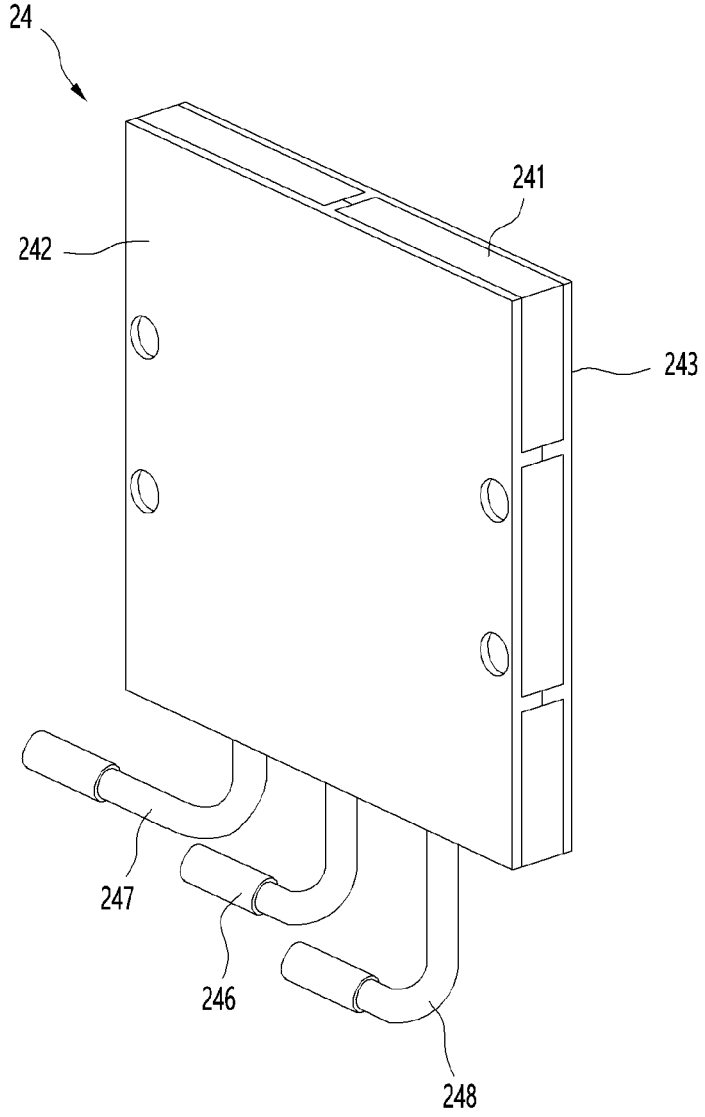
FIG. 6 is a perspective view of a heat sink constituting the thermoelectric module according to an embodiment.

FIG. 6 is a perspective view of the heat sink constituting the thermoelectric module according to an embodiment.

Figure 7:
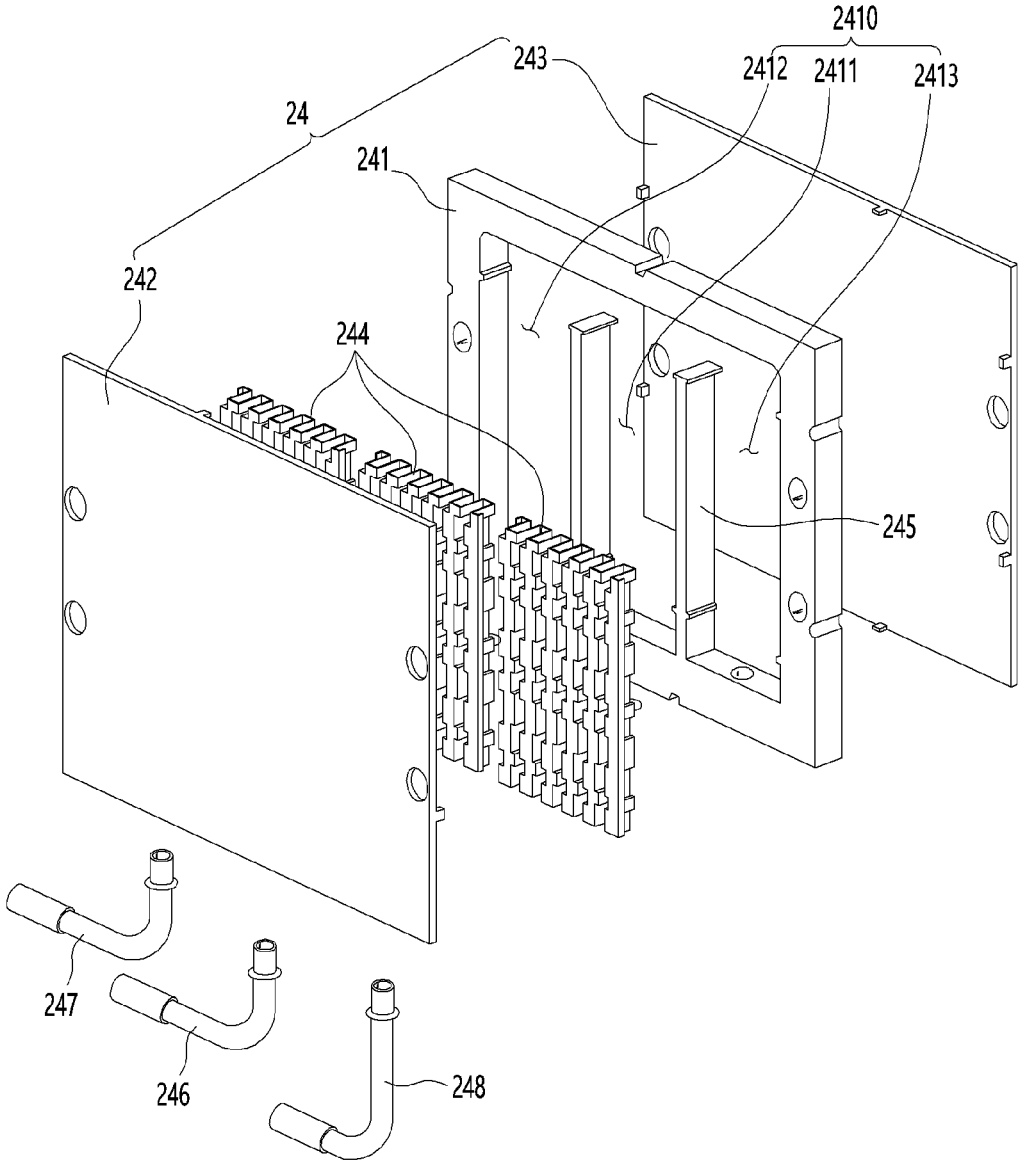
FIG. 7 is an exploded perspective view of the heat sink.

Referring to FIGS. 6 and 7, the heat sink 24 constituting the thermoelectric module 20 according to an embodiment of the present invention may include a sink frame 241 in which a refrigerant flow space 2410 is recessed in a front surface thereof, a front cover 242 covering a front surface of the sink frame 241, a rear cover 243 covering a rear surface of the sink frame 241, a plurality of divider 245 partitioning the refrigerant flow space 2410 into a plurality of spaces, a plurality of heat exchange fins 244 respectively placed in the plurality of spaces partitioned by the plurality of dividers 245, and a refrigerant inflow pipe 246 and refrigerant discharge pipes 247 and 248 connected to an outer surface of the sink frame 241.

In detail, the refrigerant discharge pipes 247 and 248 include a first refrigerant discharge pipe 247 disposed at one side of left and right sides of the refrigerant inflow pipe 246 and a second refrigerant discharge pipe 246 disposed at the other side of the left and right sides of the refrigerant inflow pipe 246.

In detail, since the specific structure of the heat exchange fin 244 is the same as that of the heat exchange fin described in the prior art, a detailed description thereof will be omitted.

Figure 8:
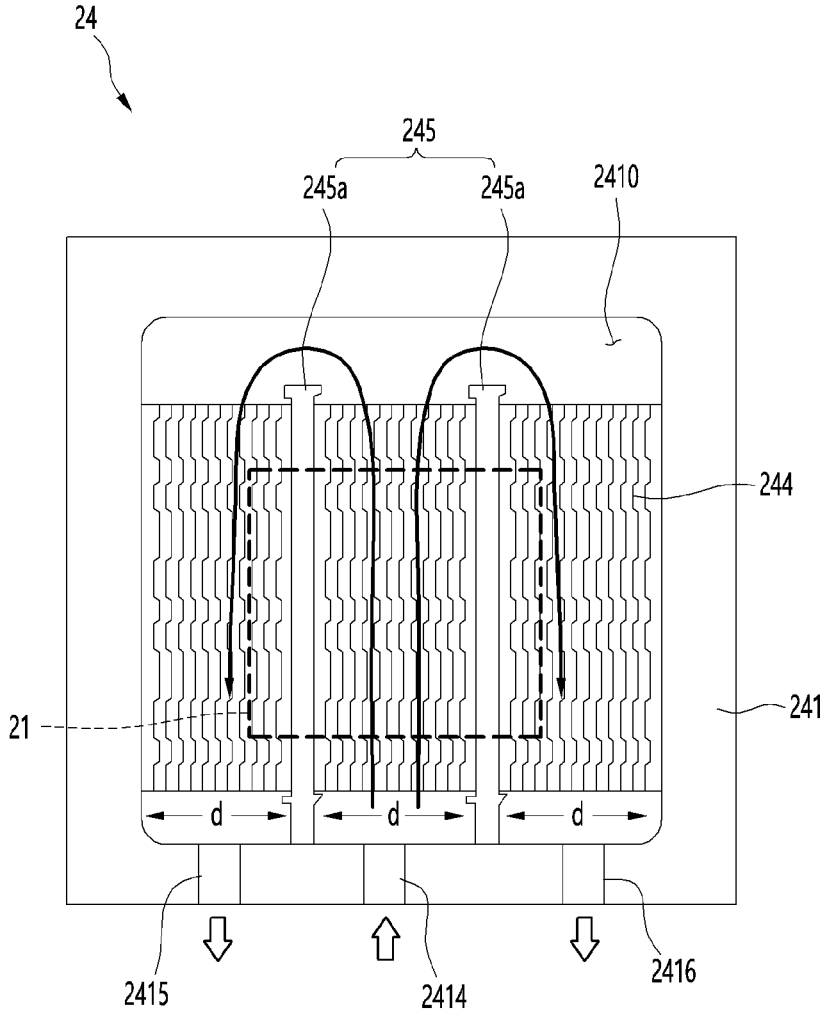
FIG. 8 is a front view of a heat sink in a state in which a front cover is removed according to an embodiment of the present invention.

FIG. 8 is a front view of the heat sink in a state in which the front cover is removed according to an embodiment of the present invention.

Referring to FIG. 8, the sink frame 241 may have a rectangular ring shape in which the refrigerant flow space 2410 is formed therein.

In detail, the refrigerant flow space 2410 may be divided into a first space 2411, a second space 2412, and a third space 2413 by the pair of dividers 245. A plurality of heat exchange fins 244 are accommodated in the first to third spaces 2411, 2412, and 2413, respectively.

The pair of dividers 245 include a first divider 245*a* closer to a left edge of the refrigerant flow space 2410 in the drawing and a second divider 245*b* closer to a right edge of the refrigerant flow space 2410 in the drawing.

In addition, in the state in which the sink frame 241 is erected, an inflow port 2414, a first discharge port 2415, and a second discharge port 2416 may be formed on the sink frame 241 corresponding to the bottom of the first to third spaces.

The first discharge port 2415 may be formed on either one side of left and right sides of the inflow port 2414, and the second discharge port 2415 is formed on the other side of the left and right sides of the inflow port 2414.

In detail, the inflow port 2414 may be designed to pass through the sink body 241 so as to communicate with the second space 2412, the first discharge port 2415 may be designed to pass through the sink body 241 so as to communicate with the second space 2412, and the second discharge port 2416 may be designed to communicate with the third space 2413.

According to this embodiment, widths d of the first to third spaces may be set to be the same.

The inflow port 2414 is formed at a central point of the refrigerant flow space 2410, and the refrigerant introduced into the refrigerant flow space 2410 through the inflow port 2414 passes through the heat exchange fin 244 disposed in the first space 2441 to flow to an opposite surface of a surface formed by the inflow port 2414.

The flow of the refrigerant is divided into left and right sides, and a flow direction is switched and guided to the second space 2412 and the third space 2413. The refrigerant guided to the second space 2412 and the third space 2413 is discharged to the outside of the heat sink 24 through the first refrigerant discharge pipe 247 and the second refrigerant discharge pipe 248.

When the heat generation surface of the thermoelectric element 21 indicated by a dotted line in FIG. 8 is attached to the front surface of the heat sink 24, a line passing through the inflow port 2414 may be attached to a point that passes through the center of the thermoelectric element 21.

That is, in a state in which the thermoelectric element 21 is attached to the heat sink 24, the line passing through the center of the inflow port 2414 bisect the refrigerant flow space 2410 corresponding to a projection surface of the thermoelectric element 21 into left and right sides.

When power is applied to the thermoelectric element 21, the central portion of the heat generation surface of the thermoelectric element has the greatest amount of heat generated at the center of the heat generation surface, and therefore, the central portion of the heat generation surface has to be rapidly cooled. Therefore, it is preferable that the low temperature refrigerant introduced through the inflow port 2414 flows first into a portion of the heat sink that is in contact with the central portion of the thermoelectric element.

Also, according to this embodiment, it is seen that the refrigerant flow space corresponding to the projection surface of the thermoelectric element is divided into a plurality of refrigerant passages having different flow directions due to overlapping of the projection surface of the thermoelectric element and the plurality of dividers.

Figure 9:
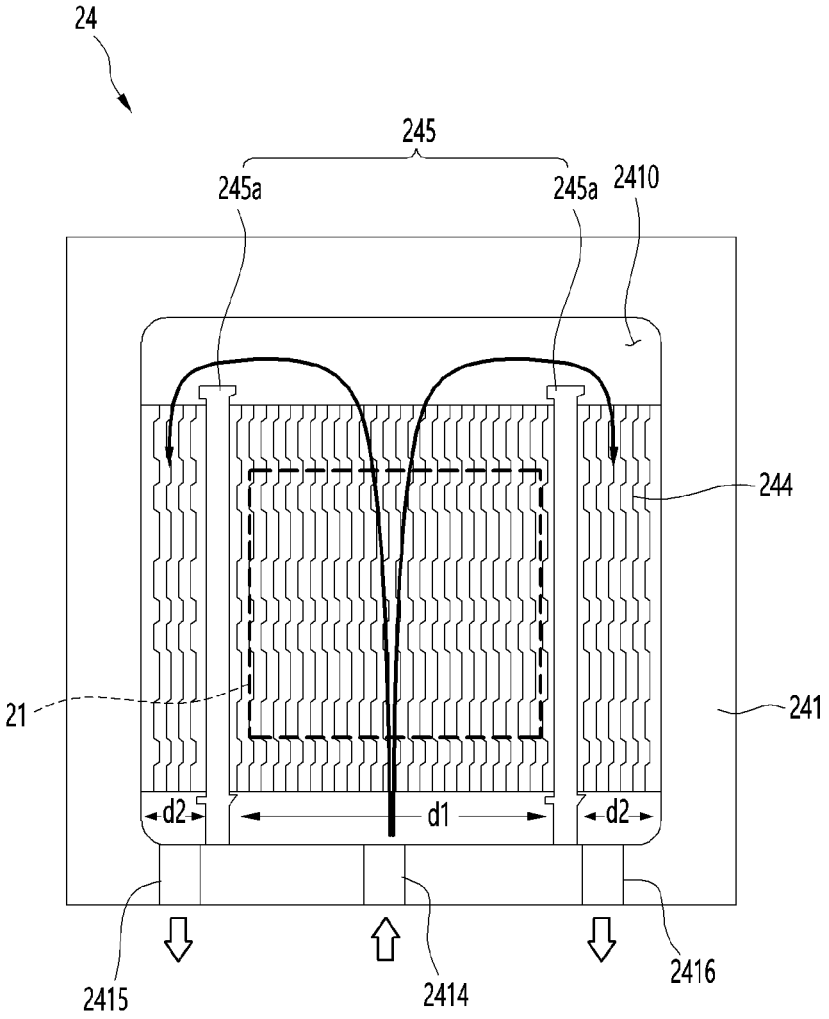
FIG. 9 is a front view of a heat sink in a state in which a front cover is removed according to another embodiment of the present invention.

FIG. 9 is a front view of a heat sink in a state in which a front cover is removed according to another embodiment of the present invention.

Referring to FIG. 9, in a heat sink 24 according to this embodiment, a width d1 of a first space portion 2411 in which the refrigerant is introduced into the refrigerant flow space 2410 through the inflow port 2414 has a length corresponding to the width of the thermoelectric element 21.

In detail, as the width d1 of the first space 2411 increases corresponding to the width of the thermoelectric element 21, a width d2 of the second space portion 2412 and a width d3 of the third space portion 2413 are reduced. The width d2 of the second space portion 2412 and the width d3 of the third space portion 2413 may be set to be the same.

The positions of the first discharge port 2415 and the second discharge port 2416 are also changed toward the left and right edges of the sink frame 241 as the width d1 of the first space portion 2411 increases.

Since a flow passage cross-sectional area of the first space 2411 is larger than a flow passage cross-sectional area of each of the second and third spaces 2412 and 2413, a refrigerant flow rate in the first space 2411 is slower than that in each of the second and third spaces 2412 and 2413. Thus, a time taken to allow the refrigerant passing through the first space 2411 to be heat-exchanged with the heat generation surface of the heat generation surface of the thermoelectric element 21 to increase in heat dissipation amount.

Figure 10:
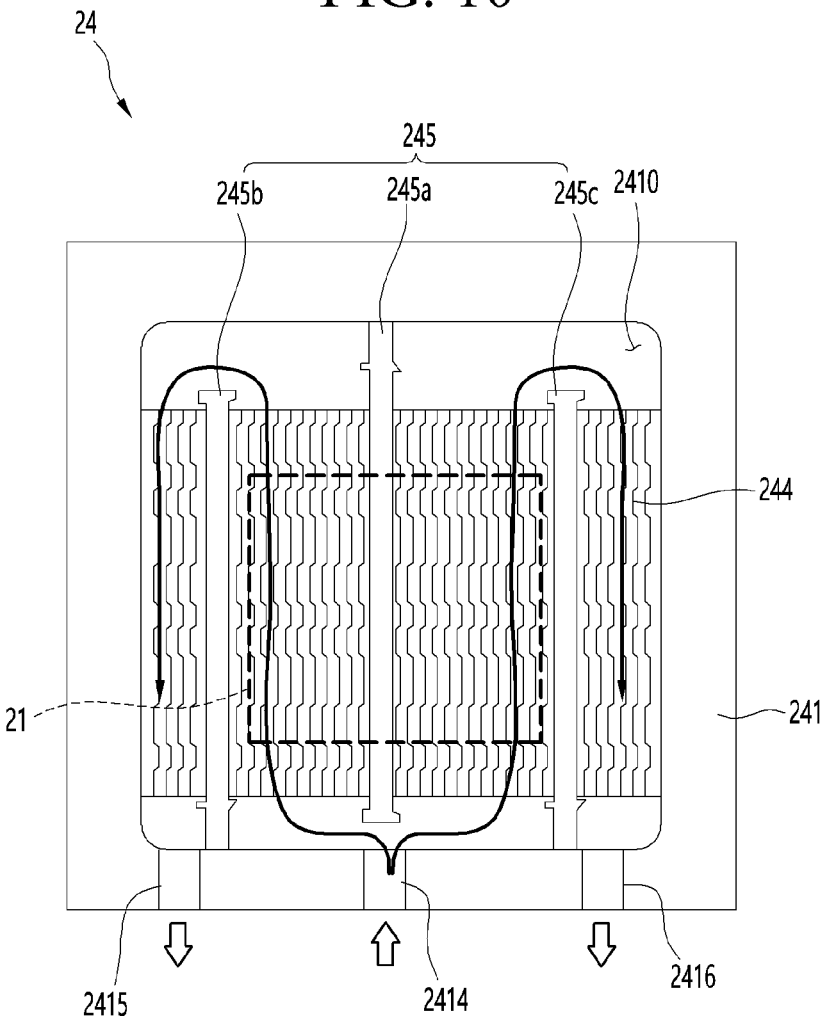
FIG. 10 is a front view of a heat sink in a state in which a front cover is removed according to further another embodiment of the present invention.

FIG. 10 is a front view of a heat sink in a state in which a front cover is removed according to further another embodiment of the present invention.

Referring to FIG. 10, in a heat sink 24 according to this embodiment, in the structure of the heat sink 24 illustrated in FIG. 9, the first space 2411 is further partitioned into two spaces by an additional divider.

In detail, a first divider 245*a* may divide a first space 2411 into a left space and a right space, a second divider 245*b* may partition a second space 2412 from the left space 2412, and the third divider 245*c* may partition the right space from a third space 2413.

Then, the low temperature and low pressure refrigerant flowing into the refrigerant flow space 2410 through the inflow port 2414 flows into the left space and the right space.

Figure 11:
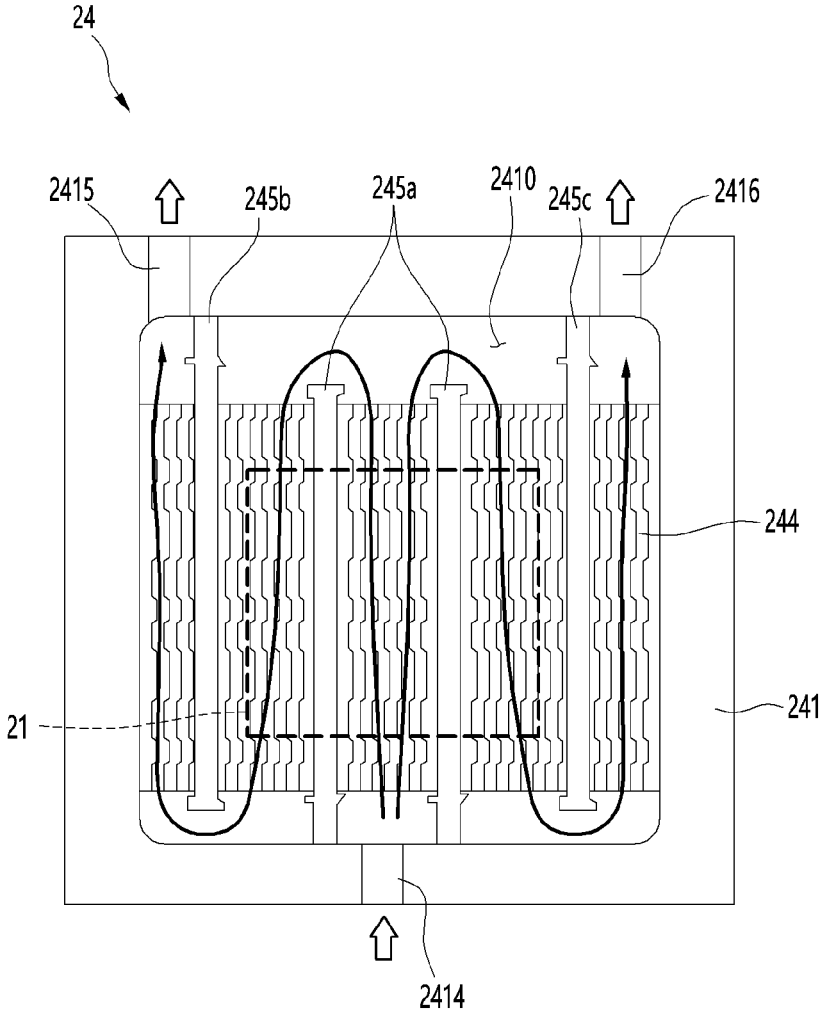
FIG. 11 is a front view of a heat sink in a state in which a front cover is removed according to further another embodiment of the present invention.
Figure 12:
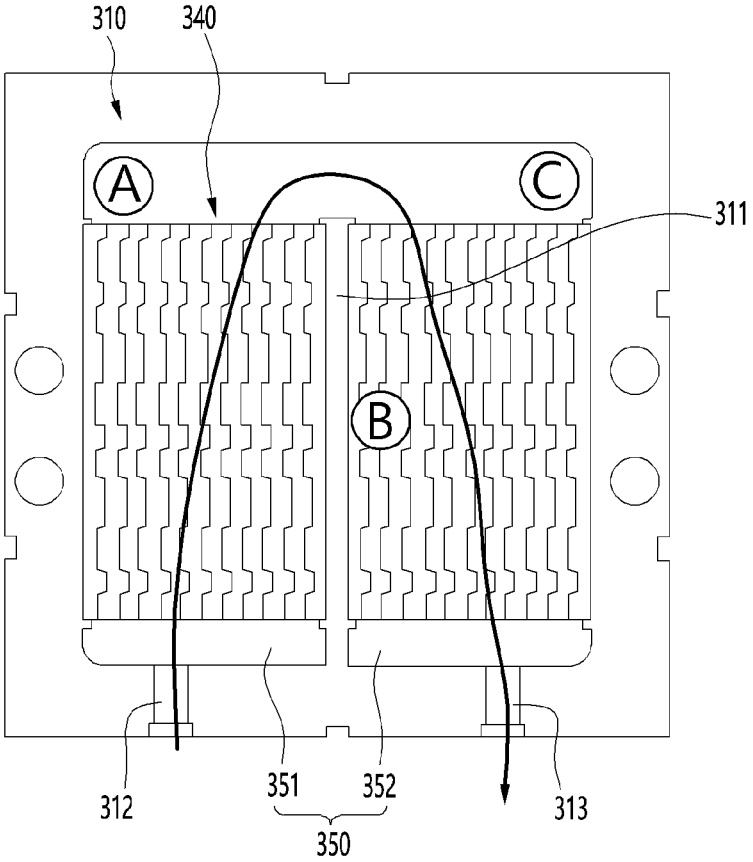
FIG. 12 is a front view of a heat sink in a state in which a front cover is removed according to a related art.

FIG. 11 is a front view of a heat sink in a state in which a front cover is removed according to further another embodiment of the present invention.

Referring to FIG. 11, the heat sink 24 according to this embodiment is characterized in that the discharge port is formed at an opposite side of an inflow port.

In detail, the inflow port 2414 of a heat sink 24 according to this embodiment is disposed on a line passing through a center of a thermoelectric element, like the foregoing embodiment. Two first dividers 245*a* are provided so that a space formed between the two first dividers 245*a* passes through a center of a refrigerant flow space 2410.

A second divider 245*b* and a third divider 245*c* may be installed at positions spaced apart to left and right sides of the two first dividers 245*a*. A first discharge port 2415 and a second discharge port 2416 are formed in a portion of a sink frame 241, which corresponds to an opposite side of the inflow port 2414.

In summary, in the structure of the heat sink 24 according to an embodiment illustrated in FIG. 9, the two dividers are disposed in the first space 2411 to subdivide the first space 2411 into a left space, a central space, and a right space.

The first discharge port 2415 is formed at a rear end of the second space 2412, and the second discharge port 2416 is formed at a rear end of the third space 2413.

According to this structure, a flow rate of the refrigerant introduced into the refrigerant flow space 2410 is reduced while performing flow conversion several times, and as a result, a time taken to be heat-exchanged with a heat generation surface of the thermoelectric element increases.

The invention claimed is:

1. A refrigerator comprising:

a freezing compartment;

a deep freezing compartment accommodated in the freezing compartment and partitioned from the freezing compartment;

a thermoelectric module disposed behind the deep freezing compartment to cool a temperature of the deep freezing compartment lower than a temperature of the freezing compartment; and a deep freezing compartment fan to cause air within the deep freezing compartment to forcibly flow, wherein the thermoelectric module comprises:

a thermoelectric element comprising a heat absorption surface facing the deep freezing compartment and a heat generation surface that is an opposite surface of the heat absorption surface;

a cold sink in communication with the heat absorption surface and disposed behind the deep freezing compartment; and a heat sink in communication with the heat generation surface and connected in series to a freezing compartment evaporator, wherein the heat sink comprises:

a sink frame having a refrigerant flow space therein;

a front cover at a front surface of the sink frame to shield a front surface of the refrigerant flow space;

a rear cover at a rear surface of the sink frame to shield a rear surface of the refrigerant flow space;

a plurality of dividers to divide the refrigerant flow space into a plurality of spaces; and a plurality of heat exchange fins disposed in the plurality of spaces divided by the plurality of dividers, wherein the sink frame comprises:

an inflow port through which a refrigerant after passing through an expansion valve is introduced into the refrigerant flow space; and a discharge port to allow the refrigerant heat exchanged with the heat generation surface of the thermoelectric element while flowing along the refrigerant flow space to be discharged to an outside of the heat sink, wherein a line passing through a center of the inflow port passes through a center portion of a projected surface of the thermoelectric element, wherein the plurality of dividers include:

a first divider spaced apart from one of two side surfaces of the sink frame and extending from a front surface of the sink frame; and a second divider spaced apart from an other of the two side surfaces of the sink frame and extending from the front surface of the sink frame, wherein the plurality of spaces include:

a first space between the first divider and the second divider;

a second space between the one side surface of the sink frame and the first divider and having a width which is smaller than a width of the first space; and a third space between the other side surface of the sink frame and the second divider and having a width which is same as the width of the second space, wherein the projected surface of the thermoelectric element is defined at the first space, wherein the inflow port is formed at a first surface of the sink frame and is in communication with the first space, wherein the discharge port includes:

a first discharge port which is formed at the first surface of the sink frame and is in communication with the second space; and a second discharge port which is formed at the first surface of the sink frame and is in communication with the third space.

2. The refrigerator according to claim 1, further comprising a third divider which extends from a second surface of the sink frame to divide the first space into a third space and a fourth space, the second surface being opposite to the first surface, wherein the third divider and the inflow port are disposed along a same line such that the refrigerant introduced in the first space through the inflow port is divided to flow towards the third space and the fourth space.

3. A thermoelectric module comprising:

a thermoelectric element comprising a heat absorption surface and a heat generation surface that is an opposite surface of the heat absorption surface;

a cold sink in communication with the heat absorption surface; and a heat sink in communication with the heat generation surface, wherein the heat sink comprises:

a sink frame having a refrigerant flow space therein;

a front cover at a front surface of the sink frame to shield a front surface of the refrigerant flow space;

a rear cover at a rear surface of the sink frame to shield a rear surface of the refrigerant flow space;

a plurality of dividers to divide the refrigerant flow space into a plurality of spaces; and a plurality of heat exchange fins disposed in the plurality of spaces divided by the plurality of dividers, wherein the sink frame comprises:

an inflow port through which a refrigerant is introduced into the refrigerant flow space; and a discharge port to allow the refrigerant heat exchanged with the heat generation surface of the thermoelectric element while flowing along the refrigerant flow space to be discharged to an outside of the heat sink, wherein a line passing through a center of the inflow port passes through a center portion of a projected surface of the thermoelectric element, wherein the plurality of dividers include:

a first divider spaced apart from one of two side surfaces of the sink frame and extending from a front surface of the sink frame; and a second divider spaced apart from an other of the two side surfaces of the sink frame and extending from the front surface of the sink frame, wherein the plurality of spaces include:

a first space between the first divider and the second divider;

a second space between the one side surface of the sink frame and the first divider and having a width which is smaller than a width of the first space; and a third space between the other side surface of the sink frame and the second divider and having a width which is the same as the width of the second space, wherein the projected surface of the thermoelectric element is defined at the first space, wherein the inflow port is formed at a first surface of the sink frame and is in communication with the first space, wherein the discharge port includes:

a first discharge port which is formed at the first surface of the sink frame and is in communication with the second space; and a second discharge port which is formed at the first surface of the sink frame and is in communication with the third space.

4. The thermoelectric module according to claim 3, further comprising a third divider which extends from a second surface of the sink frame to divide the first space into a third space and a fourth space, the second surface being opposite to the first surface, wherein the third divider and the inflow port are disposed along a same line such that the refrigerant introduced in the first space through the inflow port is divided to flow towards the third space and the fourth space.

* * * * *